United States Patent [19]

Rogak et al.

[11] Patent Number: 4,575,962

[45] **Date of Patent: * Mar. 18, 1986**

[54] UNITARY BOLT FACE AND FIRING PIN DEVICE

[75] Inventors: Michael Rogak, Antioch; Leonard W. Golan, Winnetka; Charles Witbeck, Mundelein; Stephen L. Golan, Chicago, all of Ill.

[73] Assignee: Hawk Industries, Inc., Chicago, Ill.

[ * ] Notice: The portion of the term of this patent subsequent to Jul. 31, 2001 has been disclaimed.

[21] Appl. No.: 590,011

[22] Filed: Mar. 16, 1984

Related U.S. Application Data

[63] Continuation-in-part of Ser. No. 290,606, Aug. 6, 1981, Pat. No. 4,462,179.

[51] Int. Cl.[4] ..... F41C 11/00; F41D 7/08

[52] U.S. Cl. ..... 42/1 Q; 42/16; 89/194

[58] Field of Search ..... 42/1 Q, 16, 70 R; 89/194, 195

[56] References Cited

U.S. PATENT DOCUMENTS

| | | | |
|---|---|---|---|
| 2,491,539 | 12/1949 | Windham | 89/194 |
| 2,809,564 | 10/1957 | Pope | 89/194 |
| 4,462,179 | 7/1984 | Rogak et al. | 42/1 Q |

FOREIGN PATENT DOCUMENTS

| | | | |
|---|---|---|---|
| 1231009 | 9/1960 | France | 89/194 |

*Primary Examiner*—Charles T. Jordan
*Assistant Examiner*—Ted L. Parr
*Attorney, Agent, or Firm*—Martin Faier

[57] ABSTRACT

A unitary bolt face and firing pin device for firearms consisting of a self-adjusting head space block on the front of the bolt assembly facing the chamber in firing alignment with the primer of a cartridge inserted into said chamber, the face of said head space block having integrally formed thereon a firing pin for impacting with said cartridge primer when said bolt assembly is closed against said chamber.

10 Claims, 5 Drawing Figures

UNITARY BOLT FACE AND FIRING PIN DEVICE

This application is a continuation-in-part of co-pending application Ser. No. 290,606, filed Aug. 6, 1981, U.S. Pat. No. 4,462,179, for a CHAMBER ALIGNMENT AND SAFETY SYSTEM FOR FIREARMS.

This invention relates to firearms and is more particularly directed to a unitary bolt face and firing pin device for such equipment.

Conventionally, the face of a bolt assembly may have a depression at the chamber intended to accommodate the primer end of a cartridge, and a firing pin is usually arranged to pass through the bolt face striking the cartridge primer to ignite it. The firing pin is usually spring driven and released upon activating a trigger mechanism. Where the firing pin or bolt face or chamber becomes out of line due to wear or inaccuracy of manufacture, or there is a variance in the position of the primer, or the forward face of the chamber has become abraded or foreign material is lodged at its shoulders, frequently of only micron dimensions, a misfire can result and the necessary firing contact of the firing pin on the cartridge primer cannot occur. Additionally, in some rapid fire types of weapons, such as most sub-machine guns, this primer-firing pin arrangement becomes even more critical and misalignment can prevent use of the weapon under emergency conditions.

One arrangement for accommodating variances in the chamber seating arrangement is disclosed in co-pending application Ser. No. 290,606, filed Aug. 6, 1981, U.S. Pat. No. 4,462,179, in which the present applicants are co-inventors, which is similar to the present structure, except in the prior disclosure the firing pin passes through the head space adapter block, and in the present disclosure the firing pin is formed on the leading face of the head space adapter block. This difference in structure permits the firing pin to engage the primer each time the bolt assembly is brought in contact with the chamber, and in some cases where the bolt assembly is fixed or has a short throw, as in the case with a machine gun, the presence of the firing pin on the leading face of the head space block can permit firing at a very rapid rate, with constant alignment of the firing pin and cartridge primer, irrespective of the slight variances discussed above.

OBJECTS AND ADVANTAGES OF THE INVENTION

It is the object of the invention to provide a unitary bolt face and firing pin device of the character referred to.

Another object is to provide a bolt face arrangement which is unitary with a firing pin formed on its forward face.

Another object is to provide a cartridge firing arrangement where a spring mounted head space block having an integral firing pin formed thereon is aligned with the primer of a cartridge arranged in a chamber.

Another object is to provide floating action for a head space block having an integral firing pin formed thereon which is self adjusting.

Another object is to provide a unitary bolt face and firing pin device for firearms which is relatively simple and inexpensive to manufacture and install in a weapon and which is very efficient and safe in use.

These and other objects and advantages of the present invention will become more apparent as this description proceeds, taken in conjunction with the appended claims and the accompanying drawings.

DESCRIPTION OF A PREFERRED EMBODIMENT

Figure 1:
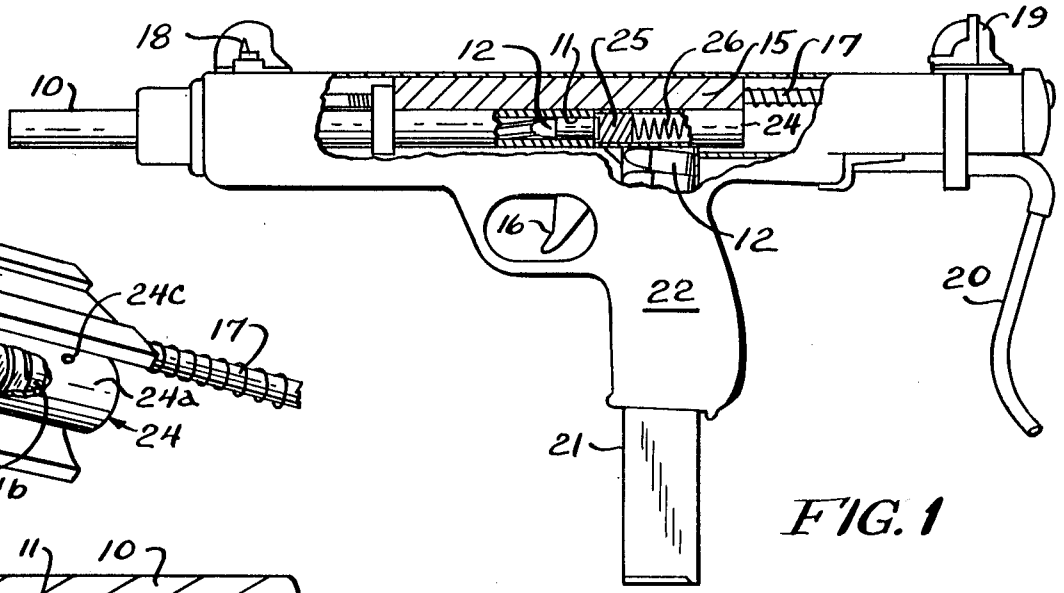
FIG. 1 is a side elevational view of a typical MPi69 sub-machine gun, with parts broken away, and altered to accommodate and incorporate the Unitary Bolt Face and Firing Pin Device embodying the present invention.

Firearms, such as a 9 mm Steyr-Daimler-Puch MPi 69 sub-machine gun of the type shown in FIG. 1, have a breech portion containing a barrel assembly 10 and a chamber 11, into which a cartridge is inserted, for firing through the barrel assembly. Actuation of the firing operation is controlled by a bolt assembly 15, which may be controlled by a trigger assembly 16, in a sub-machine gun usually powered by a driving spring assembly 17. The weapon usually has front and rear sights, 18 and 19, and a support butt 20. The magazine 21 is contained within the pistol grip 22, and has therein a series of aligned cartridges 12, which enter the chamber 11 one at a time by means of a feeding assembly, and are lodged against a shoulder 11*a* in the chamber.

Figure 5:
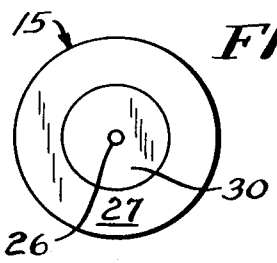
FIG. 5 is a cross-sectional view taken on line 5—5 of FIG. 3.
Figure 2:
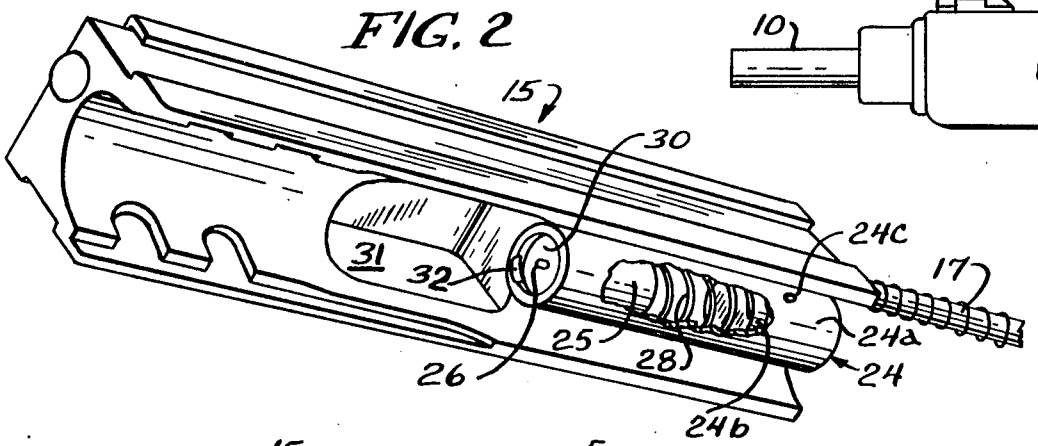
FIG. 2 is an enlarged view of the bolt assembly for the device shown in FIG. 1, embodying the present invention.
Figure 3:
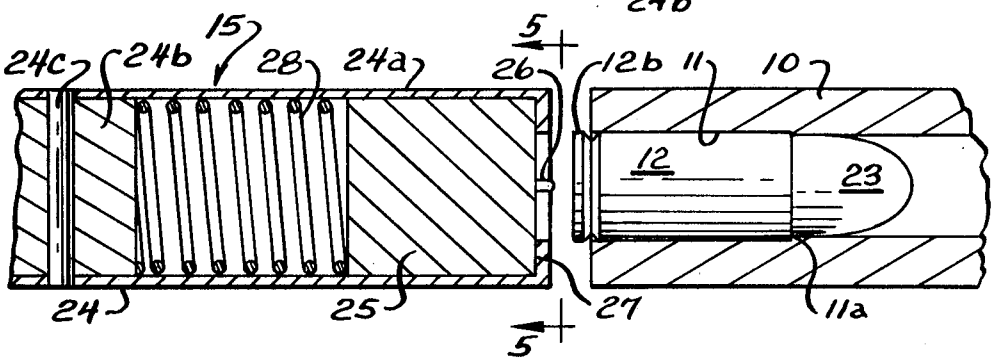
FIG. 3 is an enlarged detailed sectional view of the bolt face and chamber shown in FIG. 1 at the moment prior to impact of the bolt on the cartridge.
Figure 4:
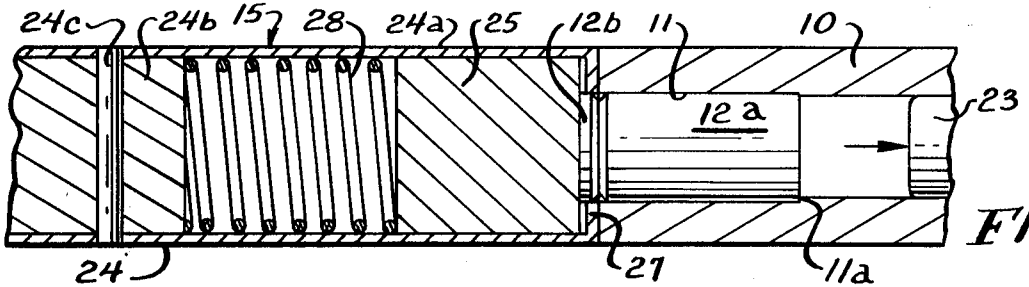
FIG. 4 is a view similar to FIG. 3, except at the moment of impact of the bolt on the cartridge.

With reference to FIGS. 2–5, when a cartridge 12 is inserted into the chamber 11, and the firing pin 26 comes into contact thereagainst, the projectile 23 is ejected from the casing 12*a* of the cartridge and fired through the barrel assembly 10. As shown in FIGS. 3–5, contact of the firing pin 26 on the rear or primer end 12*b* of the cartridge is made by striking the primer for ignition of the cartridge.

The bolt assembly 15 comprises a cylindrical body 24 which has been milled or otherwise formed to provide a housing 24*a*, a fixed block 24*b* at one end of the housing held in position by a pin 24*c*, and a forward or contact block 25 upon which is formed the firing pin 26. The housing 24*a* has a flange 27 at its forward end. Constant pressure on the bolt face block 25 is maintained by means of a spring 28 which bears against the fixed block 24*b* of the bolt assembly 15. The face of the forward block 25 surrounding the firing pin 26 forms recess 30 for accommodating the primer end 12*b* of the cartridge 12.

Thus the firing pin 26 is formed integrally with the forward block 25 of the bolt assembly 15, and constant pressure is exerted on the primer end of the cartridge 12, irrespective of minor variations in the length of the cartridge, position of the primer cap or adjustment or wear of the firing pin 26, bolt assembly 15, or chamber 11, or accumulation of small quantities of foreign matter at the chamber shoulder 11*a*.

Usually spent casings are extracted from the chamber 11 by means of extractor mechanism 32 which may be aligned with an aperture 31 in the bolt assembly 15 for removing the spend casings from the weapon. These and other mechanism and feeding devices are normally conventional, and usually do not affect the operation of the unitary bolt face and firing pin device embodying the present invention.

While a preferred embodiment of the invention has been shown and described, it is not intended that the invention should be limited to the exact structure shown, and the unitary firing pin and bolt face block embodying the present invention may be used with many types of firearms, whether operated automatically or manually.

We claim:

1. A unitary bolt face and firing pin device for a firearm having a chamber for receiving a cartridge, one end of said cartridge having a primer, and a bolt face and firing pin device facing said chamber adapted for striking said primer end, said device comprising: a body movable toward and away from said chamber, a contact block at one end and within the confines of said body facing said chamber, a recess in said body aligned over said contact block adapted to bear upon said cartridge end at multiple points thereof, spring means in said body biasing said contact block toward said chamber for snugly engaging said cartridge end and seating said cartridge in firing position in said chamber, and firing pin means integral with and arranged centrally of said block projecting therefrom in alignment with said cartridge end adapted for firing said cartridge when said firing pin means strikes said cartridge end.

2. The unitary bolt face and firing pin device recited in claim 1, wherein said block is flexibly restrained within said bolt assembly.

3. The unitary bolt face and firing pin device recited in claim 2 wherein said spring means comprises a spring seated within a recess in said body.

4. The unitary bolt face and firing pin device recited in claim 3, wherein said body has a flange arranged on its end facing said chamber for securing said block within said body.

5. The unitary bolt face and firing pin device recited in claim 3, wherein one end of said spring bears against said contact block and an opposed end of said spring bears against another block fixed within said body.

6. The unitary bolt face and firing pin device recited in claim 1, wherein said firing pin means comprises a projection extending from said recess at least the heighth of said recess.

7. The unitary bolt face and firing pin device recited in claim 6, wherein said projection is arranged centrally of said recess.

8. The unitary bolt face and firing pin device recited in claim 6, wherein said body, spring means and contact block are arranged co-axially with said chamber.

9. The unitary bolt face and firing pin device recited in claim 8, wherein said spring means and contact block and a fixed block are arranged within a housing.

10. The unitary bolt face and firing pin device recited in claim 9, wherein a pin through said fixed block secures said fixed block in said housing.

* * * * *